US007059371B2

(12) United States Patent
Renn

(10) Patent No.: US 7,059,371 B2
(45) Date of Patent: Jun. 13, 2006

(54) SECURITY HANDBAG SYSTEM

(76) Inventor: Michael J. Renn, 2912 East McKellips Rd. Unit 83, Mesa, AZ (US) 85213

( * ) Notice: Subject to any disclaimer, the term of this patent is extended or adjusted under 35 U.S.C. 154(b) by 0 days.

(21) Appl. No.: 10/934,708

(22) Filed: Sep. 3, 2004

(65) Prior Publication Data

US 2005/0056674 A1 Mar. 17, 2005

Related U.S. Application Data

(60) Provisional application No. 60/502,677, filed on Sep. 12, 2003.

(51) Int. Cl.

| | |
|---|---|
| ***A45C 1/04*** | (2006.01) |
| ***A45C 1/08*** | (2006.01) |
| ***A45C 3/06*** | (2006.01) |
| ***A45C 13/02*** | (2006.01) |

(52) U.S. Cl. ..... 150/101; 150/102; 150/111; 150/113; 190/101; 190/108; 190/110; 224/625; 224/663

(58) Field of Classification Search ..... 150/100–102, 150/104, 105, 111, 113; 190/100–102, 108, 190/110; 224/625, 663

See application file for complete search history.

(56) References Cited

U.S. PATENT DOCUMENTS

| | | | | |
|---|---|---|---|---|
| 1,532,710 | A * | 4/1925 | Nellegar, Jr. | 190/101 |
| 2,783,926 | A * | 3/1957 | Wise | 224/667 |
| 3,286,751 | A * | 11/1966 | Dishart | 206/0.81 |
| 3,727,657 | A | 4/1973 | Landis | |
| 3,881,534 | A | 5/1975 | Gist | |
| 3,949,915 | A * | 4/1976 | Burhans | 224/269 |
| 4,804,122 | A * | 2/1989 | Knox | 224/220 |
| 4,995,436 | A | 2/1991 | Cantor | |
| 5,197,525 | A | 3/1993 | Cantor | |
| 5,207,254 | A * | 5/1993 | Fromm | 150/104 |
| 6,446,688 | B1 | 9/2002 | Sutton | |
| 2002/0148872 | A1 * | 10/2002 | DeVolentine et al. | 224/665 |

FOREIGN PATENT DOCUMENTS

FR 2660840 A1 * 10/1991

* cited by examiner

*Primary Examiner*—Sue A. Weaver
(74) *Attorney, Agent, or Firm*—Stoneman Law Offices, Ltd.; Martin L. Stoneman

(57) ABSTRACT

A security handbag system comprising a purse with a detachable portion removably coupled to the side of the purse and attached to the waist of a user. The detachable portion has pockets to hold the users valuables including cash, credit cards, defensive chemical spray and cellular phone. Upon extraordinary pulling away of the purse, the detachable portion remains attached to the user and uncouples from the purse.

22 Claims, 3 Drawing Sheets

SECURITY HANDBAG SYSTEM

CROSS-REFERENCE TO RELATED APPLICATION

The present application is related to prior provisional application Ser. No. 60/502,677, filed Sep. 12, 2003, entitled "SECURITY HANDBAG SYSTEM", from which priority is claimed, the contents of which are incorporated herein by this reference and are not admitted to be prior art with respect to the present invention by the mention in this cross-reference section.

BACKGROUND

This invention relates to providing a system for reducing theft of valuables carried in a handbag, more specifically, a woman's purse.

Typically, a woman transports a purse by holding it adjacent the body or using a shoulder carrying strap to suspend the purse over the shoulder and adjacent the body. There are a growing number of thieves that prefer to steal such purses by grabbing the shoulder straps, snatching the purse and running off, thereby taking the valuables within the purse with them.

It would be useful to provide a purse that assists protecting the user and valuables.

OBJECTS AND FEATURES OF THE INVENTION

A primary object and feature of the present invention is to provide a system for improving the protection of valuables carried in a purse.

It is a further object and feature of the present invention to provide such a system that provides a secured purse portion within the purse.

It is a further object and feature of the present invention to provide such a system wherein the secured portion is attached to the user and wherein the secured portion separates from the purse upon extraordinary pulling away of the purse.

It is a further object and feature of the present invention to provide such a system wherein accessing the internal portion of the purse provides access to the secured portion.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment of the present invention this invention provides a security handbag system for assisting in the secure transport of user-selected contents comprising, in combination: at least one first container means for containing at least one first portion of the user-selected contents; and at least one second container means, having at least one interior first side and at least one exterior second side, removably coupled to such at least one first container means for containing at least one second portion of the user-selected contents; wherein such at least one first container means comprises, at least one exterior side portion; at least one accessible interior pocket; and at least one access means for providing access to such at least one accessible interior pocket; wherein such at least one accessible interior pocket further comprises at least one cavity means, located on one of such at least one exterior side portion, for containing such at least one interior first side; and wherein such at least one first container means comprises removable coupling means for removably coupling such at least one first container means with such at least one second container means; wherein such at least one interior first side is contained within such at least one cavity means when such at least one second container means is coupled to such at least one first container means; wherein such at least one interior first side is accessible from such at least one accessible interior pocket when such at least one second container means is coupled to such at least one first container means; wherein such at least one exterior second side comprises first attachment means for attaching such second container means to a user; and wherein extraordinary pulling of such first container means causes such second container means, when attached to a user, to uncouple from such first container means.

Furthermore, it provides such a security handbag wherein such at least one first container means further comprises shoulder carrying means for assisting shoulder carrying of such at least one first container means. Additionally, it provides such a security handbag wherein such at least one interior first side comprises holding means for holding the at least one second portion of contents. Also, it provides such a security handbag wherein such first attachment means comprises looping means for assisting attachment to a user's belt. In addition, it provides such a security handbag wherein such at least one access means comprises at least one closure means for closing such at least one access means. And, it provides such a security handbag wherein such removable coupling means comprises hook and loop fabric.

In accordance with another preferred embodiment hereof, this invention provides a security handbag system for assisting in the secure transport of user-selected contents comprising, in combination: at least one first container adapted to contain at least one first portion of the user-selected contents; and at least one second container, having at least one interior first side and at least one exterior second side, removably coupled to such at least one first container adapted to contain at least one second portion of the user-selected contents; wherein such at least one first container comprises, at least one exterior side portion; at least one accessible interior pocket; and at least one access structured and arranged to provide access to such at least one accessible interior pocket; wherein such at least one accessible interior pocket further comprises at least one cavity, located on one of such at least one exterior side portion, for containing such at least one interior first side; and wherein such at least one first container comprises at least one removable coupler to removably couple such at least one first container with such at least one second container; wherein such at least one interior first side is contained within such at least one cavity when such at least one second container is coupled to such at least one first container; wherein such at least one interior first side is accessible from such at least one accessible interior pocket when such at least one second container is coupled to such at least one first container; wherein such at least one exterior second side comprises at least one first attacher to attach such at least one second container to a user; and wherein extraordinary pulling of such at least one first container causes such at least one second container, when attached to a user, to uncouple from such at least one first container.

Further, it provides such a security handbag wherein such at least one first container further comprises at least one shoulder carrying element structured and arranged to assist shoulder carrying of such at least one first container. Even further, it provides such a security handbag wherein such at least one interior first side comprises at least one holder to hold the at least one second portion of contents. Moreover, it provides such a security handbag wherein such at least one first attacher comprises at least one loop adapted to assist attachment of such at least one second container to a user's belt. Additionally, it provides such a security handbag wherein such at least one access comprises at least one closure adapted to close such at least one access. Also, it provides such a security handbag wherein such at least one holder comprises a plurality of pockets.

In addition, it provides such a security handbag wherein such plurality of pockets comprises at least one pocket structured and arranged to hold at least one credit card. And, it provides such a security handbag wherein such plurality of pockets comprises at least one pocket structured and arranged to hold a self-defense weapon. Further, it provides such a security handbag wherein such plurality of pockets comprises at least one cellular phone pocket structured and arranged to hold a cellular phone. Even further, it provides such a security handbag wherein: such at least one removable coupler comprises at least one first coupler on such at least one first container and at least one second coupler on such at least one second container; and wherein such at least one first coupler couples to such at least one second coupler.

Even further, it provides such a security handbag wherein such at least one first coupler and such at least one second coupler comprises hook and loop fabric. Even further, it provides such a security handbag wherein such at least one first attacher comprises at least one quick-connect fastener adapted to secure such at least one second container to a user. Even further, it provides such a security handbag wherein such at least one closure is a zippered closure.

DETAILED DESCRIPTION OF THE BEST MODE AND PREFERRED EMBODIMENTS OF THE INVENTION

Figure 1:
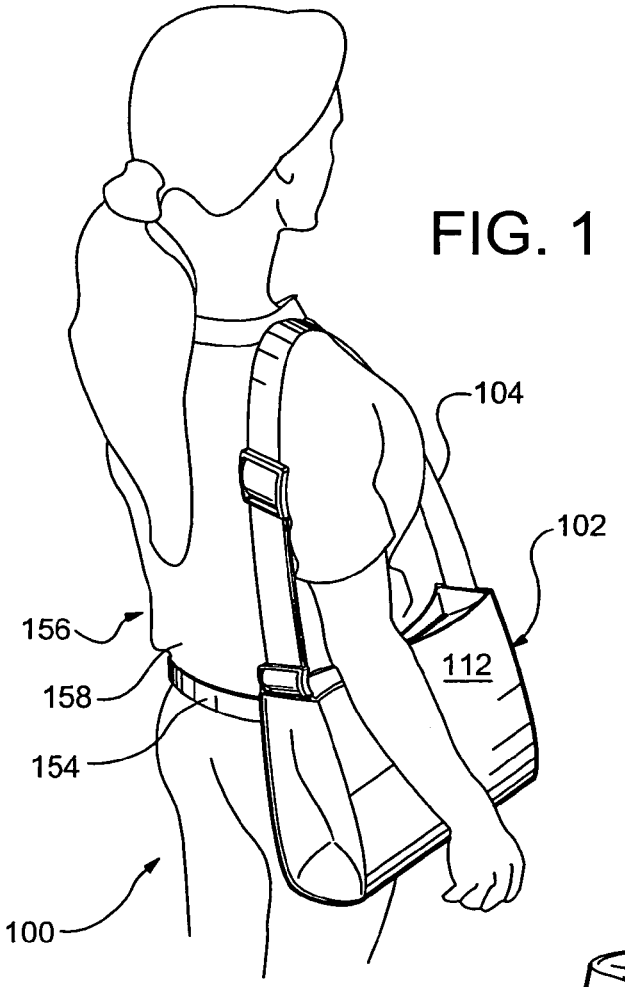
FIG. 1 shows a perspective view of the security handbag system according to a preferred embodiment of the present invention.
Figure 2:
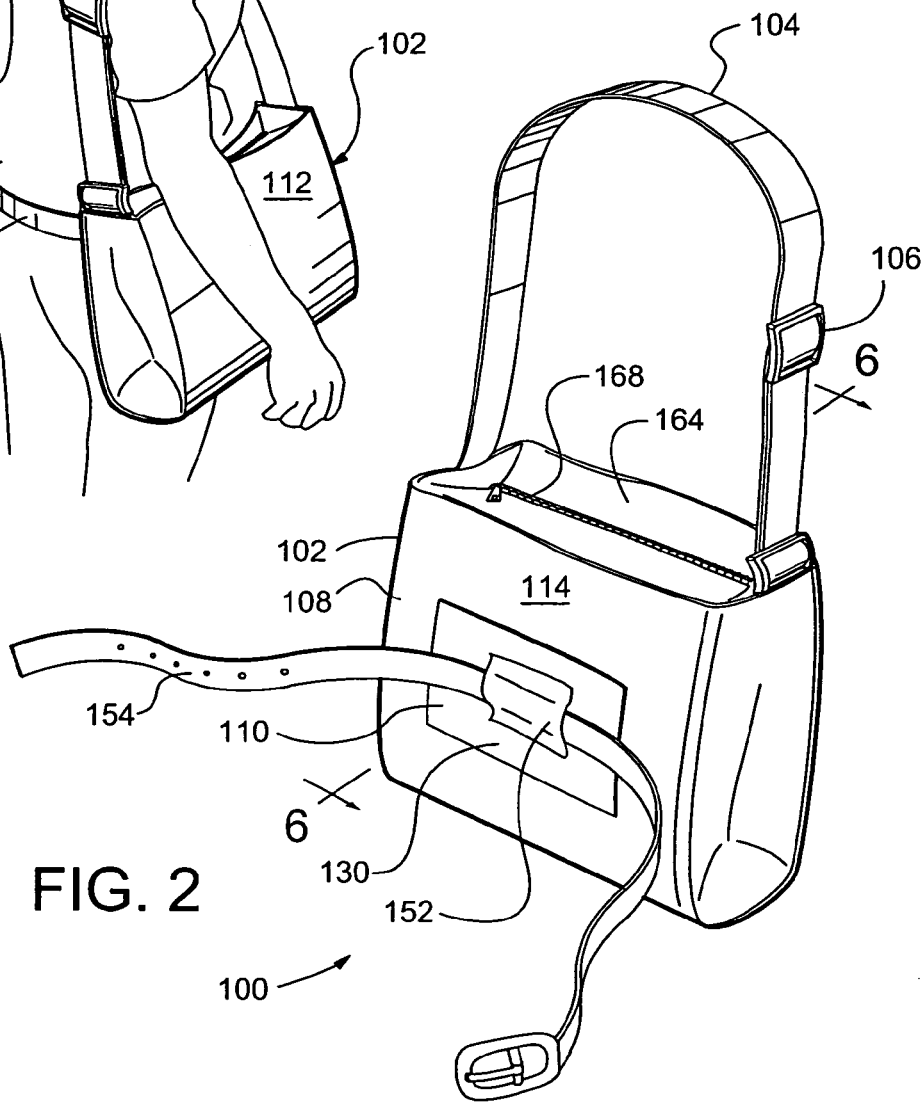
FIG. 2 shows a perspective view of the security handbag system of FIG. 1.

FIG. 1 shows a perspective view of the security handbag system 100 according to a preferred embodiment of the present invention. FIG. 2 shows a perspective view of the security handbag system 100 of FIG. 1. Preferably, the security handbag system 100 comprises a handbag such as purse 102 (embodying herein at least one first container means for containing at least one first portion of the user-selected contents; and embodying herein at least one first container adapted to contain at least one first portion of the user-selected contents), as shown. Preferably, the purse 102 is made of leather or other durable product. Preferably, the purse 102 comprises a shoulder strap 104 (embodying herein wherein such at least one first container means further comprises shoulder carrying means for assisting shoulder carrying of such at least one first container means; and, embodying herein wherein such at least one first container further comprises at least one shoulder carrying element structured and arranged to assist shoulder carrying of such at least one first container), preferably leather, that is used to carry the purse 102 in a typical manner with the strap 104 over the shoulder and the purse 102 under the shoulder, as shown. Upon reading the teachings of this specification, those with ordinary skill in the art will now understand that, under appropriate circumstances, considering such issues as economic consideration, user preference, material availability, durability, climate, country of use, etc., other materials for the purse and purse strap, such as nylon, plastic, fabric, metals, woven textiles, etc., may suffice.

Preferably, the shoulder strap 104 is adjustable in length, most preferably utilizing a buckle 106 to adjust the strap 104 length such that the purse 102 is situate adjacent the users waist 156, as shown. Preferably, the purse 102 comprises two distinct purse portions, a first purse portion 108 and a second purse portion 110. Preferably, the first purse portion 108 is a "decoy" purse portion and the second purse portion 110 is a secured purse portion, as shown.

Preferably, the first purse portion 108 comprises at least two exterior sides, an integral "normal" appearing side 112 and a side 114 (embodying herein wherein such at least one first container means comprises at least one exterior side portion; and embodying herein wherein such at least one first container comprises at least one exterior side portion) comprising a second purse portion 110, as shown. Preferably, the second purse portion 110 is removably coupled to the first purse portion 108, as shown (embodying herein wherein such at least one first container means comprises removable coupling means for removably coupling such at least one first container means with such at least one second container means; and, embodying herein wherein such at least one first container comprises at least one removable coupler to removably couple such at least one first container with such at least one second container).

Figure 3:
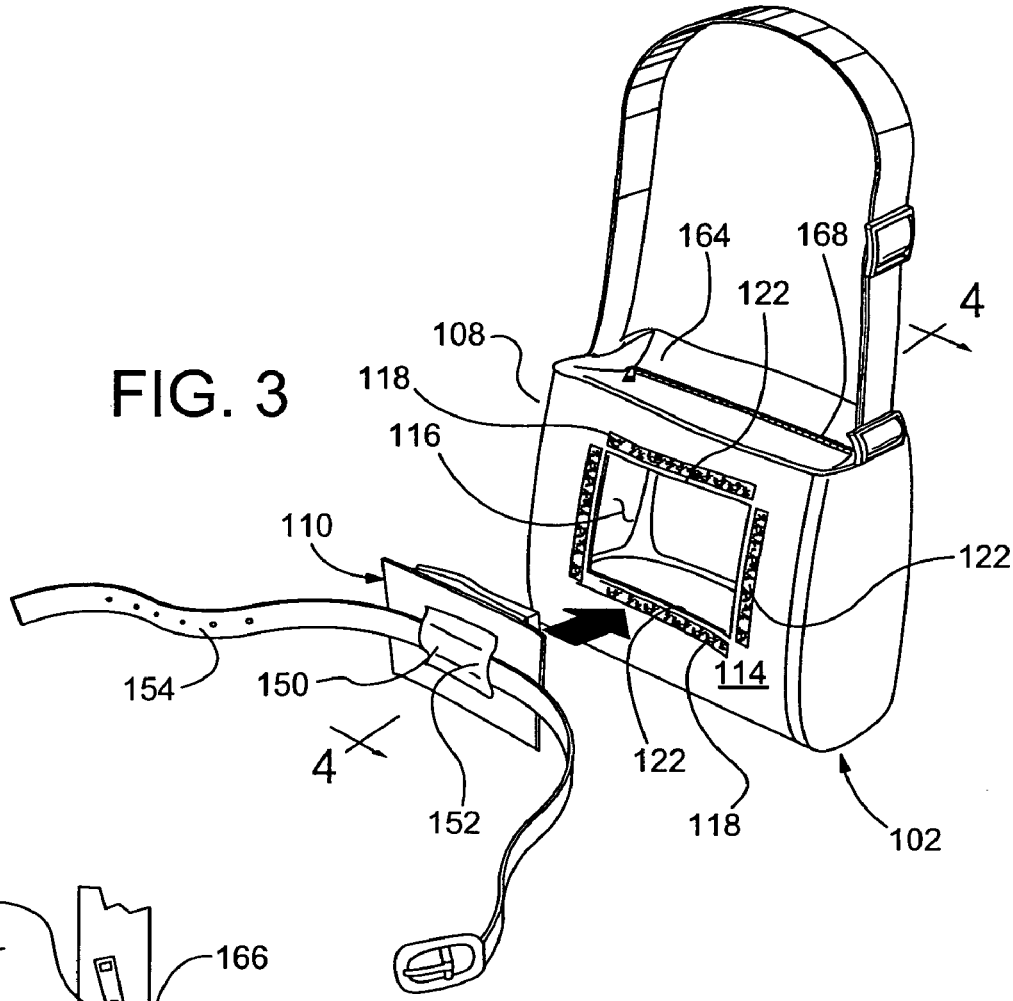
FIG. 3 shows an exploded perspective view of the security handbag system of FIG. 1.
Figure 4:
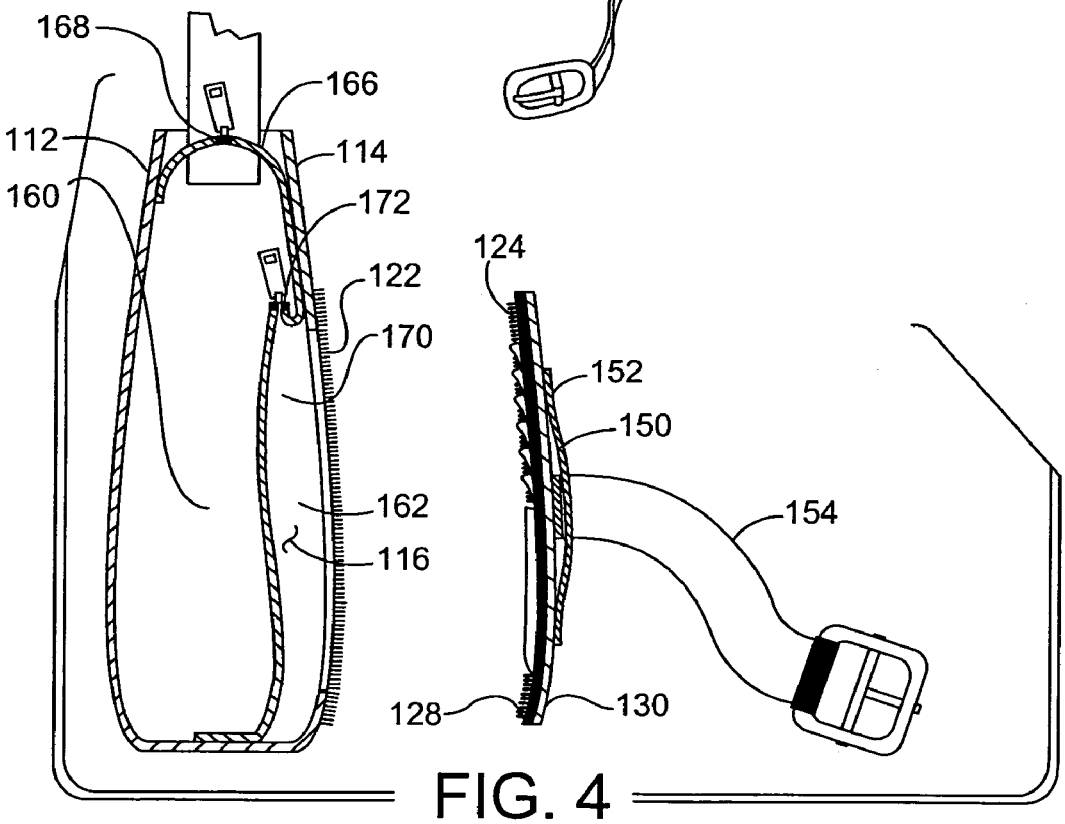
FIG. 4 shows a sectional view through section 4—4 of FIG. 3.

FIG. 3 shows an exploded perspective view of the security handbag system 100 of FIG. 1. FIG. 4 shows a sectional view Through section 4—4 of FIG. 3. Preferably, the first purse portion 108 comprises a cavity 116 that is sized to accept and contain the second purse portion 110, when removably coupled, as shown (embodying herein wherein such at least one interior first side is contained within such at least one cavity means when such at least one second container means is coupled to such at least one first container means; and, embodying herein wherein such at least one interior first side is contained within such at least one cavity when such at least one second container is coupled to such at least one first container). Preferably, the second purse portion 110 is removably coupled to the first purse portion 108 using a hook and loop fabric 118 (for example, Velcro®), as shown (embodying herein wherein such removable coupling means comprises hook and loop fabric; and, embodying herein wherein such at least one first coupler and such at least one second coupler comprises hook and loop fabric). Preferably, the loop fabric is permanently attached to the exterior of side 114, most preferably adjacent the perimeter 122 of cavity 116, as shown. Preferably, the loop fabric 118 encircles the perimeter 122 such that when coupled with the second purse portion 110 a seal is formed to resist foreign matter (such as, for example, dirt and rain) from entering the cavity 116. Upon reading the teachings of this specification, those with ordinary skill in the art will now understand that, under appropriate circumstances, considering such issues as, user preference, preferred manufacture techniques, economic considerations, etc., other removable coupling means, such as snaps, removable adhesive, removable mechanical attachment, etc., may suffice.

Preferably, the second purse portion 110 comprises an interior portion 128 and an exterior portion 130, as shown (the above described arrangement of the second purse portion 110 embodies herein at least one second container means, having at least one interior first side and at least one exterior second side, removably coupled to such at least one first container means for containing at least one second portion of the user-selected contents; and embodies herein at least one second container, having at least one interior first side and at least one exterior second side, removably coupled to such at least one first container adapted to contain at least one second portion of the user-selected contents). Preferably, the interior portion 128 comprises hook fabric 124, preferably complimentary to the loop fabric such that the hook fabric 124 and loop fabric 118 will couple together when pressed together (this arrangement embodies herein wherein such at least one removable coupler comprises at least one first coupler on such at least one first container and at least one second coupler on such at least one second container; and, wherein such at least one first coupler couples to such at least one second coupler). Preferably, the hook fabric 124 is permanently attached near the perimeter of the interior portion 128 of the second purse portion 110, as shown. Preferably, such permanent attachment is stitching, however, under appropriate circumstances, adhesive attachment may suffice. Most preferably, there is a slight overhang of purse material 132, preferably leather, preferably about one-quarter to one-half inch wide, that assists in sealing the first purse portion 108 and second purse portion 110 when coupled.

It is noted that upon reading the teachings of this specification, those with ordinary skill in the art will now understand that, under appropriate circumstances, considering such issues as economics, durability, purse material, etc., other methods of coupling first purse portion 108 and second purse portion 110, such as variations of the hook and loop fabric arrangements and placement, etc., may suffice.

Figure 5:
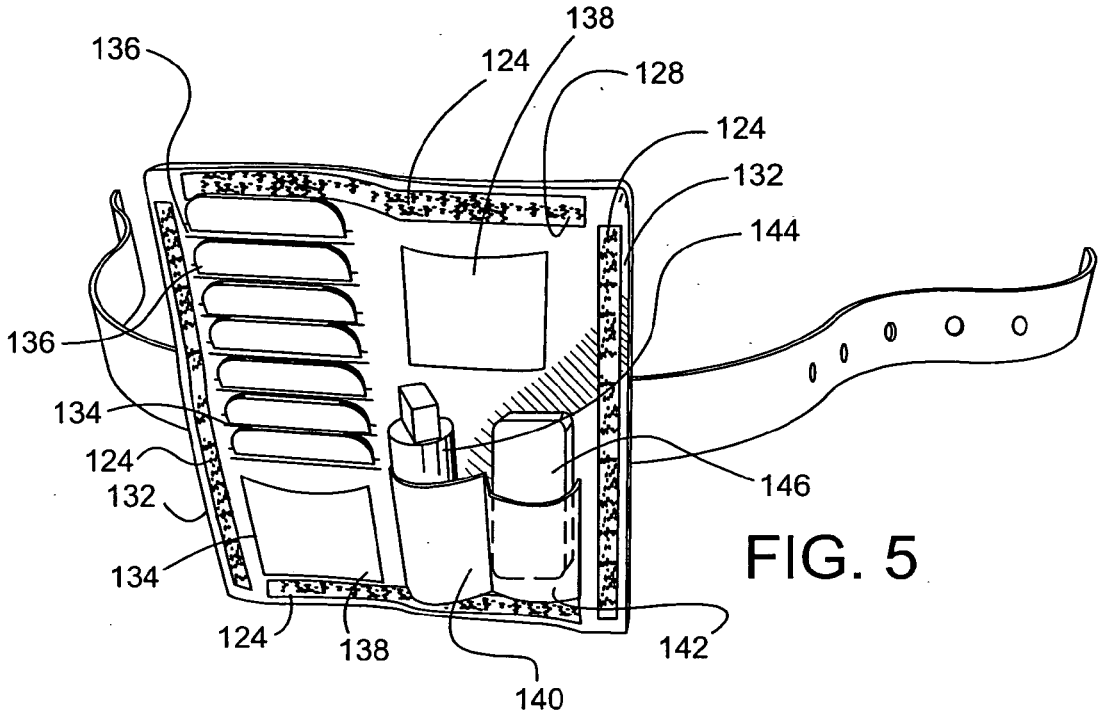
FIG. 5 shows a perspective view of a second purse portion of the purse of FIG. 2.
Figure 6:
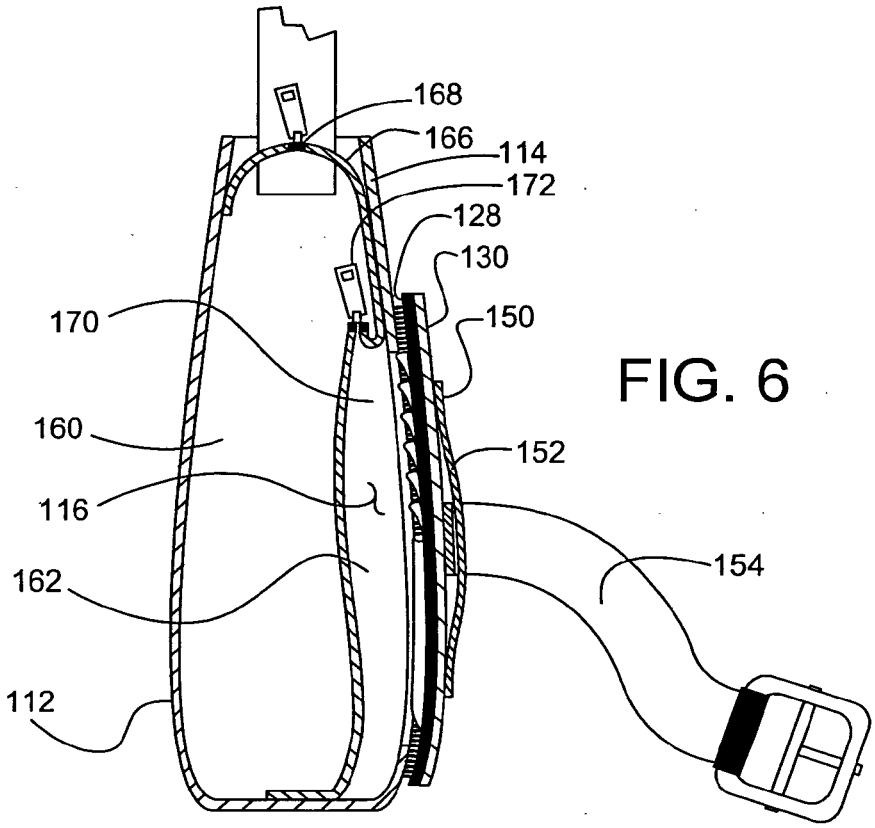
FIG. 6 shows a sectional view through section 6—6 of FIG. 2.

FIG. 5 shows a perspective view of the second purse portion 110 of the purse 102 of FIG. 2. FIG. 6 shows a sectional view through section 6—6 of FIG. 2. Preferably, the interior portion 128 of the second purse portion 110 holds the purse 102 valuables. Preferably, such valuables include credit cards, money, cell phone, etc. Preferably, the interior portion 128 comprises a plurality of pockets 134 (embodying herein wherein such at least one interior first side comprises holding means for holding the at least one second portion of contents; and, embodying herein wherein such at least one interior first side comprises at least one holder to hold the at least one second portion of contents; and, also embodying herein wherein such at least one holder comprises a plurality of pockets), most preferably a set of credit card pockets 136 (embodying herein wherein such plurality of pockets comprises at least one pocket structured and arranged to hold at least one credit card), accessory pockets 138, a defensive weapon pocket 140 (embodying herein wherein such plurality of pockets comprises at least one pocket structured and arranged to hold a self-defense weapon), preferably for a chemical defensive spray 144 and a cell phone pocket 142 (embodying herein wherein such plurality of pockets comprises at least one cellular phone pocket structured and arranged to hold a cellular phone), preferably for a cell phone 146, as shown. Upon reading the teachings of this specification, those with ordinary skill in the art will now understand that, under appropriate circumstances, considering such issues as economic consideration, user preference, material availability, durability, climate, country of use, etc., other pocket arrangements, such as more or less pockets, larger or smaller pockets, cash pockets, etc., may suffice.

Preferably, the exterior portion 130 comprises an attacher 150 (embodying herein wherein such at least one exterior second side comprises first attachment means for attaching such second container means to a user; and, embodying herein wherein such at least one exterior second side comprises at least one first attacher to attach such at least one second container to a user) for attaching the second purse portion 110 to a security handbag user 156 (see FIG. 1). Preferably, the attacher 150 is a belt loop 152, as shown. Preferably, a user places a belt 154 through the belt loop 152 (embodying herein wherein such first attachment means comprises looping means for assisting attachment to a user's belt; and, embodying herein wherein such at least one first attacher comprises at least one loop adapted to assist attachment of such at least one second container to a user's belt) and around the users waist 158 to provide a quick-connect sturdy attachment of the second purse portion 110 to the user 156 (embodying herein wherein such at least one first attacher comprises at least one quick-connect fastener adapted to secure such at least one second container to a user). It is noted that upon reading the teachings of this specification, those with ordinary skill in the art will now understand that, under appropriate circumstances, considering such issues as user preferences, economic considerations, material preferences, country of use, etc., other methods of attaching the second purse portion 110 to a security handbag user 156, such as using a different quick-connect fastener, for example, a carabiner, etc., may suffice.

Preferably, the first purse portion 108 comprises a first internal pocket 160 (embodying herein wherein such at least one first container means comprises at least one accessible interior pocket) and most preferably, a second internal pocket 162, as shown. Preferably, the first internal pocket 160 is accessed from the top 164 of the purse 102, preferably through an access opening 166 (embodying herein at least one access means for providing access to such at least one accessible interior pocket; and, embodying herein at least one access structured and arranged to provide access to such at least one accessible interior pocket), as shown. Preferably, the access opening 166 is closable using a zippered closure 168 (embodying herein wherein such at least one access means comprises at least one closure means for closing such at least one access means; and, embodying herein wherein such at least one access comprises at least one closure adapted to close such at least one access; and, embodying herein wherein such at least one closure is a zippered closure), as shown. Upon reading the teachings of this specification, those with ordinary skill in the art will now understand that, under appropriate circumstances, considering such issues as economic consideration, user preference, material availability, durability, climate, country of use, design preference, etc., other methods of closing the purse, such as spring purse closures, snaps, buttons, etc., may suffice. Furthermore, upon reading the teachings of this specification, those with ordinary skill in the art will now understand that, under appropriate circumstances, considering such issues as economics, user preference, design preference, etc., other pocket arrangements, such as additional pockets, pockets with side access, etc., may suffice.

Preferably, the second internal pocket 162 separates the cavity 116 from the first internal pocket 160, as shown (this arrangement embodies herein wherein such at least one accessible interior pocket further comprises at least one cavity means, located on one of such at least one exterior side portion, for containing such at least one interior first side; and, embodies herein wherein such at least one accessible interior pocket further comprises at least one cavity, located on one of such at least one exterior side portion, for containing such at least one interior first side). This arrangement is preferred so that when the second purse portion 110 is uncoupled from the first purse portion 108, the contents of the first internal pocket 160 do not fall out of the purse 102. Preferably, the second internal pocket 162 comprises an access opening 170 to provide access to the interior portion 128 (embodying herein wherein such at least one interior first side is accessible from such at least one accessible interior pocket when such at least one second container means is coupled to such at least one first container means; and, embodying herein wherein such at least one interior first side is accessible from such at least one accessible interior pocket when such at least one second container is coupled to such at least one first container), as shown. Preferably, the access opening 170 is closable using a zippered closure 172, as shown. Most preferably, the second internal pocket 162 and access opening 170 are accessible only from the first internal pocket 160 and access opening 166, as shown. Upon reading the teachings of this specification, those with ordinary skill in the art will now understand that, under appropriate circumstances, considering such issues as economics, user preference, design preference, etc., other pocket arrangements may suffice.

In operation, a user preferably places valuables in the second purse portion 110 and couples the second purse portion 110 to the first purse portion 108. Next, the second purse portion 110 is attached to the user and the shoulder strap 104 is adjustable in length such that the purse 102 appears to be being carried by the shoulder and such that the second purse portion 110 is adjacent the users waist 158, as shown. Typically, a thief who attempts to steal the purse 102 will grab the decoy portion (first purse portion 108) and use extraordinary pulling power to pull the decoy portion away from the user. Upon such extraordinary pulling, the second purse portion 110 will uncouple from the first purse portion 108 (this arrangement embodies herein wherein extraordinary pulling of such first container means causes such second container means, when attached to a user, to uncouple from such first container means; and, embodies herein wherein extraordinary pulling of such at least one first container causes such at least one second container, when attached to a user, to uncouple from such at least one first container). Preferably, the user valuables'will be retained on the user and only the decoy portion (first purse portion 108) will be stolen.

Upon reading the teachings of this specification, those with ordinary skill in the art will now understand that, under appropriate circumstances, considering such issues as user preference, economic consideration, durability, climate, country of use etc., other methods of use of the purse 102, such as to transport money, jewels or other valuables, etc., may suffice.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A security handbag system relating to assisting in the secure transport of user-selected contents comprising, in combination:

a) at least one first container means for containing at least one first portion of the user-selected contents; and b) at least one second container means, having at least one interior first side and at least one exterior second side, removably coupled to said at least one first container means, for containing at least one second portion of the user-selected contents;

c) wherein said at least one first container means comprises, i) at least one exterior side portion, ii) at least one accessible interior pocket, and iii) at least one access means for providing access to said at least one accessible interior pocket, iv) wherein said at least one accessible interior pocket further comprises at least one cavity means, located on one of said at least one exterior side portion, for containing said at least one interior first side, and v) wherein said at least one first container means comprises removable coupling means for removably coupling said at least one first container means with said at least one second container means;

d) wherein said at least one interior first side is contained within said at least one cavity means when said at least one second container means is coupled to said at least one first container means;

e) wherein said at least one interior first side is accessible from said at least one accessible interior pocket when said at least one second container means is coupled to said at least one first container means;

f) wherein said at least one exterior second side is external from said at least one first container means when said second container means is removably coupled to said at least one first container means;

g) wherein said at least one exterior second side comprises first attachment means for attaching said second container means to a user; and h) wherein extraordinary pulling of said first container means causes said second container means, when attached to a user, to uncouple from said first container means.

2. The security handbag according to claim 1 wherein said at least one first container means further comprises shoulder carrying means for assisting shoulder carrying of said at least one first container means.

3. The security handbag according to claim 1 wherein said at least one interior first side comprises holding means for holding the at least one second portion of contents.

4. The security handbag according to claim 1 wherein said first attachment means comprises looping means for assisting attachment to a user's belt.

5. The security handbag according to claim 1 wherein said at least one access means comprises at least one closure means for closing said at least one access means.

6. The security handbag according to claim 1 wherein said removable coupling means comprises hook and loop fabric.

7. A security handbag system relating to assisting in the secure transport of user-selected contents comprising, in combination:

a) at least one first container adapted to contain at least one first portion of the user-selected contents; and b) at least one second container, having at least one interior first side and at least one exterior second side, removably coupled to said at least one first container, adapted to contain at least one second portion of the user-selected contents;

c) wherein said at least one first container comprises, i) at least one exterior side portion, ii) at least one accessible interior pocket, and iii) at least one access structured and arranged to provide access to said at least one accessible interior pocket, iv) wherein said at least one accessible interior pocket further comprises at least one cavity, located on one of said at least one exterior side portion, for containing said at least one interior first side, and v) wherein said at least one first container comprises at least one removable coupler to removably couple said at least one first container with said at least one second container;

d) wherein said at least one interior first side is contained within said at least one cavity when said at least cue second container is coupled to said at least one first container;

e) wherein said at least one interior first side is accessible from said at least one accessible interior pocket when said at least one second container is coupled to said at least one first container;

f) wherein said at least one exterior second side is external from said at least one first container when said at least one second container is removably coupled to said at least one first container;

g) wherein said at least one exterior second side comprises at least one first attacher to attach said at least one second container to a user; and h) wherein extraordinary pulling of said at least one first container causes said at least one second container, when attached to a user, to uncouple from said at least one first container.

8. The security handbag according to claim 7 wherein said at least one first container further comprises at least one shoulder carrying element structured and arranged to assist shoulder carrying of said at least one first container.

9. The security handbag according to claim 7 wherein said at least one interior first side comprises at least one holder to hold the at least one second portion of contents.

10. The security handbag according to claim 7 wherein said at least one first attacher comprises at least one loop adapted to assist attachment of said at least one second container to a user's belt.

11. The security handbag according to claim 7 wherein said at least one access comprises at least one closure adapted to close said at least one access.

12. The security handbag according to claim 9 wherein said at least one holder comprises a plurality of pockets.

13. The security handbag according to claim 12 wherein said plurality of pockets comprises at least one pocket structured and arranged to hold at least one credit card.

14. The security handbag according to claim 12 wherein said plurality of pockets comprises at least one pocket structured and arranged to hold a self-defense weapon.

15. The security handbag according to claim 12 wherein said plurality of pockets comprises at least one cellular phone pocket structured and arranged to hold a cellular phone.

16. The security handbag according to claim 7 wherein:

a) said at least one removable coupler comprises at least one first coupler on said at least one first container and at least one second coupler on said at least one second container; and b) wherein said at least one first coupler couples to said at least one second coupler.

17. The security handbag according to claim 16 wherein said at least one first coupler and said at least one second coupler comprises hook and loop fabric.

18. The security handbag according to claim 7 wherein said at least one first attacher comprises at least one quick-connect fastener adapted to secure said at least one second container to a user.

19. The security handbag according to claim 11 wherein said at least one closure is a zippered closure.

20. A security handbag system relating to assisting in the secure transport of user-selected contents comprising, in combination:

a) at least one first container adapted to contain at least one first portion of the user-selected contents; and b) at least one second container, having at least one interior first side and at least one exterior second side, removably coupled to said at least one first container, adapted to contain at least one second portion of the user-selected contents;

c) wherein said at least one first container comprises, i) at least one exterior side portion, ii) at least one accessible interior pocket, and iii) at least one access structured and arranged to provide access to said at least one accessible interior pocket, iv) wherein said at least one accessible interior pocket further comprises at least one cavity, located on one of said at least one exterior side portion, for containing said at least one interior first side, and v) wherein said at least one first container comprises at least one removable coupler to removably couple said at least one first container with said at least one second container;

d) wherein said at least one interior first side is contained within said at least one cavity when said at least one second container is coupled to said at least one first container;

e) wherein said at least one interior first side is accessible from said at least one accessible interior pocket when said at least one second container is coupled to said at least one first container;

f) wherein said at least one exterior second side is external from said at least one first container when said at least one second container is removably coupled to said at least one first container;

g) wherein said at least one exterior second side comprises at least one first attacher to attach said at least one second container to a user; and h) wherein extraordinary pulling of said at least one first container causes said at least one second container, when attached to a user, to uncouple from said at least one first container;

i) wherein said at least one first container further comprises at least one shoulder carrying element structured and arranged to assist shoulder carrying of said at least one first container;

j) wherein said at least one interior first side comprises at least one bolder to hold the at least one second portion of contents;

k) wherein said at least one first attacher comprises at least one loop adapted to assist attachment of said at least one second container to a user's belt;

l) wherein said at least one interior first side is accessible from said at least one accessible interior pocket when said at least one second container is coupled to said at least one first container;

m) wherein said at least one holder comprises a plurality of pockets n) wherein said plurality of pockets comprises at least one pocket structured and arranged to hold at least one credit card;

o) wherein said plurality of pockets comprises at least one pocket structured and arranged to hold a self-defense weapon;

p) wherein said plurality of pockets comprises at least one cellular phone pocket structured and arranged to hold a cellular phone.

21. The security handbag according to claim 20 wherein said at least one removable coupler comprises hook and loop fabric.

22. The security handbag according to claim 21 wherein said at least one first attacher comprises at least one quick-connect fastener.

* * * * *

UNITED STATES PATENT AND TRADEMARK OFFICE

CERTIFICATE OF CORRECTION

PATENT NO. : 7,059,371 B2
APPLICATION NO. : 10/934708
DATED : June 13, 2006
INVENTOR(S) : Michael J. Renn It is certified that error appears in the above-identified patent and that said Letters Patent is hereby corrected as shown below:

Column 9, line 22, “cue” should read --one--

Column 10, line 66, “bolder” should read --holder--

Signed and Sealed this

Nineteenth Day of September, 2006

JON W. DUDAS
*Director of the United States Patent and Trademark Office*